United States Patent [19]

Carlson

[11] Patent Number: 4,800,982

[45] Date of Patent: Jan. 31, 1989

[54] CLEANABLE IN-THE-EAR ELECTROACOUSTIC TRANSDUCER

[75] Inventor: Elmer V. Carlson, Prospect Heights, Ill.

[73] Assignee: Industrial Research Products, Inc., Elk Grove, Ill.

[21] Appl. No.: 108,122

[22] Filed: Oct. 14, 1987

[51] Int. Cl.[4] ..... H04R 25/00

[52] U.S. Cl. ..... 181/130; 181/135; 181/160; 381/68.6; 381/69.2; 381/159

[58] Field of Search ..... 181/126, 130, 132, 135, 181/160; 381/68.6, 69, 69.2, 187, 189, 159

[56] References Cited

U.S. PATENT DOCUMENTS

| | | | |
|---|---|---|---|
| 1,830,198 | 11/1931 | French | 181/135 |
| 2,312,534 | 3/1943 | Fiene | 181/135 |
| 3,470,328 | 9/1969 | Daniels | 381/69.2 X |
| 3,602,330 | 8/1971 | Johnson | 181/135 |
| 3,702,123 | 11/1972 | Macken et al. | 181/135 |
| 3,918,550 | 11/1975 | Milani | 181/135 |
| 3,934,100 | 1/1976 | Harada | 181/135 |
| 4,349,082 | 9/1982 | Gastmeier | 181/130 |
| 4,443,668 | 4/1984 | Warren | 181/135 X |
| 4,553,627 | 11/1985 | Gastmeier et al. | 181/135 |
| 4,679,650 | 7/1987 | Moser et al. | 181/130 |

*Primary Examiner*—B. R. Fuller

*Attorney, Agent, or Firm*—Kinzer, Plyer, Dorn, McEachran & Jambor

[57] ABSTRACT

A hearing aid including a microphone, an adjustable amplifier, and a transducer comprising an acoustic driver driving a diaphragm disposed within an acoustic chamber, all mounted in an in-the-ear housing having a sound outlet passage leading from the acoustic chamber into the user's ear canal, is provided with a cleaning passage that is accessible from the outside of the housing and that connects to the inner end of the sound outlet passage, through a portion of the acoustic chamber. Throughout internal cleaning is effected by pumping a solvent through the continuous conduit formed by the cleaning passage, the acoustic chamber, and the sound outlet passage, without disassembly of the hearing aid.

11 Claims, 1 Drawing Sheet

CLEANABLE IN-THE-EAR ELECTROACOUSTIC TRANSDUCER

BACKGROUND OF THE INVENTION

In those hearing aids that are designed to be worn in the ear of the user, the excretions that occur in the ear tend to enter the orifice or outlet passage of the hearing aid that is utilized to introduce sound from the hearing aid into the user's ear canal. Build-up of these excretions, referred to as ear wax or cerumen, ultimately blocks all or part of the sound outlet passage. The result is a malfunction of the hearing aid.

In most conventional in-the-ear hearing aids and earphones of comparable size, a build-up of cerumen or ear wax occurs in the sound outlet passage, which at times can only be corrected by at least partial disassembly of the hearing aid. Considering that these hearing aids are quite tiny, inasmuch as each such hearing aid includes a microphone, an amplifier, and a complete sound reproduction receiver all in a package small enough to fit in an ear, disassembly for cleaning purposes and the subsequent necessity for reassembly can be a difficult task for the user. Indeed, for many users, the task may be essentially impossible, and is accomplished only by returning the hearing aid or like device to the manufacturer.

SUMMARY OF THE INVENTION

Accordingly, the present invention is directed to a new and improved cleanable in-the-ear hearing aid or like device that facilitates the cleaning of ear wax or cerumen from the device without disassembly.

Another object of the invention is to provide a new and improved acoustic transducer for an in-the-ear hearing aid or like device that is simple and economical of manufacture, yet durable, and that permits rapid cleaning in a simple manner without disassembling the device.

Accordingly, the invention relates to a cleanable hearing aid or like device of the kind that fits into an ear of the user, comprising a housing having a size and configuration adapted to fit into a human ear, and having a sound outlet passage from the interior of the housing that opens into the ear canal of the user, an acoustic chamber positioned within the housing in communication with the inner end of the sound outlet passage, a sound generating diaphragm mounted in the acoustic chamber, acoustic drive means, mounted in the housing, for driving the diaphragm, and actuating means, including a microphone and amplifier mounted in the housing, for actuating the acoustic drive means. A cleaning passage extends into the housing and into communication with the innermost end of the sound outlet passage; this cleaning passage and the sound outlet passage comprises a continuous conduit such that a solvent pumped into one end of the cleaning passage from outside the housing flows through the full length of the outlet passage to clean out accumulated cerumen without disassembly of the hearing device.

DESCRIPTION OF THE PREFERRED EMBODIMENTS

Figure 1:
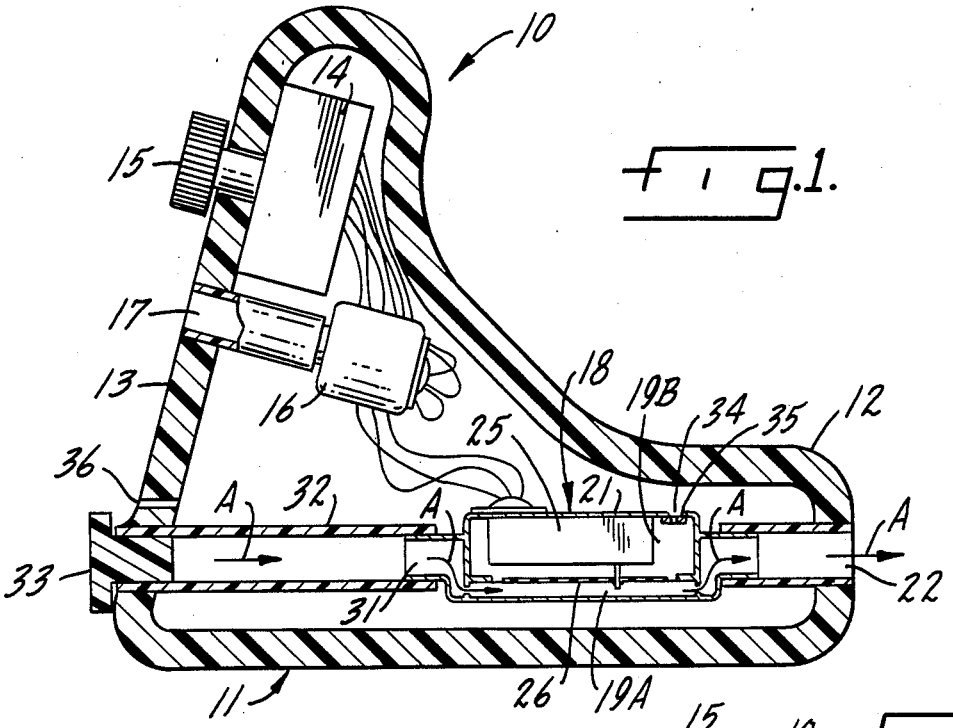
FIG. 1 is a sectional elevation view, on a greatly enlarged scale, of a cleanable in-the-ear hearing aid constructed in accordance with one preferred embodiment of the present invention.

FIG. 1 illustrates an in-the-ear hearing aid 10 that is generally conventional in much of its construction but that has been modified so that it constitutes one of the preferred embodiments of the present invention.

The hearing aid 10 of FIG. 1 includes a shell-like housing 11 having a shape that affords a conformal fit within the ear of the intended user. The portion 12 of housing 11 projects into the user's ear canal. The outer portion 13 of housing 11, generally referred to as the faceplate, is usually located somewhere between the entrance of the ear canal and the entrance of the concha, depending upon the space available in the ear of the user and the skill of the hearing aid builder.

Within the housing or shell 11, hearing aid 10 includes an amplifier and battery assembly 14, usually equipped with at least one external control 15, in this instance mounted immediately behind the faceplate 13. A microphone 16 is mounted within housing 11. An acoustical connection comprising a tube 17 extends from microphone 16 through faceplate 13 to provide access to microphone 16 for externally arriving sound.

An acoustic transducer 18, sometimes referred to as a receiver, is mounted within housing 11 in communication with a sound outlet passage 22 that emerges from the hearing aid housing portion 12. Transducer 18 includes a small housing or acoustic chamber 21 within which an acoustic driver device 25 is mounted. This acoustic drive means 25, which is electrically actuated by signals from amplifier 14, is mechanically connected to a diaphragm 26 that extends across and divides the receiver housing 21 into an outer acoustic chamber portion 19A and an inner acoustic chamber portion 19B. Drive means 25 is located within the inner acoustic chamber portion 19B.

As thus far described, the in-the-ear hearing aid 10 is essentially conventional in its construction and in its operation. Thus, sound impinging upon the hearing aid reaches microphone 16 through the acoustical connection tube 17. Microphone 16 generates an electrical signal representative of the sound and supplies that signal to the amplifier/battery assembly 14. In amplifier 14, the amplitude for its output signal may be adjusted by control 15. Other characteristics (e.g., frequency response) may also be controlled in a similar manner.

Amplifier 14 supplies an electrical drive signal to the acoustic drive means 25 in transducer 18. Drive means 25 may be of conventional electromechanical construction; the driver could also be a piezoelectric device or other type of driver. In response to the received signals from amplifier 14, driver 25 actuates diaphragm 26 to generate acoustic (sound) signals that are supplied to the ear canal of the user through sound output passage 22. In most hearing aids, a small vent is provided between the two acoustic chamber portions 19A and 19B within receiver housing 21 to equalize changes in atmospheric pressure. This venting is usually necessary because the pressure differential acting on diaphragm 26, due to atmospheric pressure variations, may be sufficient to cause driver 25 to become inoperative. No such vent is shown in hearing aid 21 because other venting arrangements are employed as described hereinafter. In some instances, an acoustic resistance or damper may be mounted in the sound output duct or passage 22 to modify the frequency response characteristics of hearing aid 10. A resistance of this kind is preferably omitted in hearing aid 10.

The usual excretions of the ear, constituting ear wax or cerumen, may enter the open end of sound outlet passage 22 from the user's ear canal. Indeed, this is quite common because the outer end of passage 22 must be open in order to transmit sound to the ear canal of the user. These excretions tend to migrate into channel 22 to an extent such that the passage is eventually blocked, preventing hearing aid 10 from operating properly. Attempts to remove the cerumen may be partially successful, but eventually some of the ear wax is likely to move inwardly far enough to block the small passages leading from the acoustic chamber portion 19A into the sound outlet passage 22. Indeed, enough of the cerumen may enter acoustic chamber portion 19A to impede the vibrations of diaphragm 26, effectively stopping operation of the hearing aid. If there is an acoustic resistance, filter, or damping element in passage 22, the likelihood of blockage is increased.

Hearing aid 10, FIG. 1, incorporates a cleaning passage 32 that extends through faceplate 13 into housing 11 in direct communication with the innermost end of sound outlet passage 22. Actually, the cleaning duct 32 is connected to the outer acoustic chamber portion 19A through a port 31; chamber 19A provides communication between diaphragm 26 and sound outlet passage 22. Thus, cleaning passage 32, port 31, acoustic chamber portion 19A, and sound outlet passage 22 comprise a continuous conduit that extends from faceplate 13 through housing 11 and out the tip end 12 of the housing, with one wall of the central part of that continuous conduit constituting diaphragm 26. A plug 33 normally closes the end of conduit 32 projecting through faceplate 13. Housing 21 of transducer 18 is vented by a small vent 34 into the interior of hearing aid housing 11, which in turn is vented to the atmosphere by a small opening 36 in faceplate 13. Vents 34 and 36 afford the necessary compensation for atmospheric pressure changes for acoustic chamber 19A, 19B.

Figure 2:
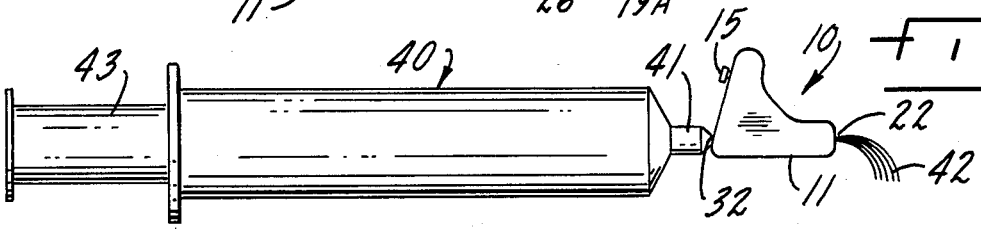
FIG. 2 is an essentially schematic illustration showing how the hearing aid of FIG. 1 is cleaned.

The manner in which accumulated ear wax or cerumen can be cleaned from hearing aid 10 is best illustrated in FIG. 2. Initially, plug 33 (FIG. 1) is removed. The tip 41 of a syringe 40 filled with a solvent for the cerumen is then inserted into the outer end of cleaning passage 32. When the plunger 43 of syringe 40 is depressed, the solvent flows through hearing aid 10 and is discharged from the outer, open end of sound outlet passage 22 as indicated at 42 in FIG. 2. The path of the solvent is illustrated, in FIG. 1, by arrows A.

In order to maintain sound outlet passage 22 unrestricted, it is preferable, as previously noted, that no filter, acoustic resistance, or other such element be mounted within the sound outlet passage. If acoustic damping or filtering is desired, an appropriate damping element may be installed in vent 34 or in acoustic chamber 19B, as indicated by reference numeral 35. Location of the damping means in this position has the additional beneficial effect of increasing the low frequency sensitivity of hearing aid 10, and also increases the maximum output sound pressure deliverable by receiver 18.

Venting of the hearing air shell or housing 11 can also be achieved through unsealed openings associated with amplifier 14, control 15, tube 17, or microphone 16; the vent openings need not be located directly in faceplate 13 as indicated by vent 36. The location of vent opening 34 into the interior of receiver housing 21 may also be modified from that shown.

As previously noted in connection with FIG. 2, an ordinary syringe 40 may be utilized to pump a quantity of a cleaning solvent through hearing aid 10. This action is effective to clean cerumen and other debris from the outer portion 19A of the acoustic chamber, from the face of diaphragm 26, and from all of outlet passage 22. After the ear wax and other debris is cleared the same syringe 40 (or another syringe) can be utilized to force drying air through the continuous conduit comprising passage 32, acoustic chamber portion 19A, and passage 22. In hearing aids and like transducers where it will not adversely affect the materials used for construction, an intermediate flush of alcohol or other rapidly evaporating solvent may be a substantial aid in the drying process.

Figure 3:
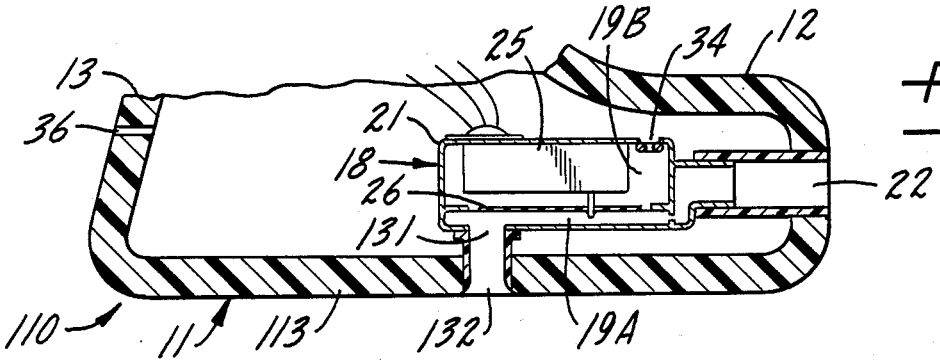
FIG. 3 is a detail sectional elevation view, similar to a portion of FIG. 1, of another embodiment of the invention.

FIG. 3 illustrates another construction for implementation of the invention that functions in essentially the same manner as the embodiment of FIG. 1. In the construction shown in FIG. 3, a hearing aid 110 of the same construction as the previously described hearing aid 10 is provided, except that cleaning passage 32 and plug 33 (FIG. 1) are eliminated. In hearing aid 110 there is a cleaning passage 132 which enters housing 11 through a side wall 113 and connects directly to the innermost end of portion 19A of the acoustic chamber, the end opposite outlet passage 22, through a port 131. No plug is necessary for channel 132 because its opening through wall 113 is effectively sealed off by contact with the surface of the user's ear canal. Clean-out operation for hearing aid 110 is the same as for hearing aid 10 of FIG. 1 in all respects, including effective cleaning of the surface of diaphragm 26 that is exposed to cerumen accumulation.

Figure 4:
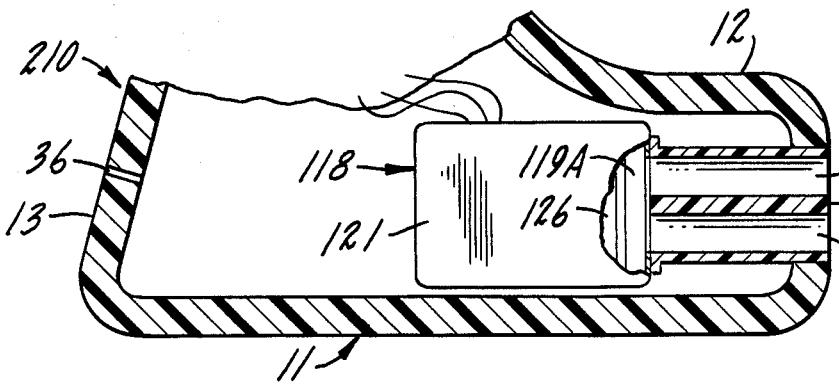
FIG. 4 is a detail sectional view, like FIG. 3, of another embodiment of the invention.

FIG. 4 illustrates the sound output portion of a hearing aid 210 which constitutes another embodiment of the invention. In this instance, for purposes of illustration the receiver transducer 118 of the hearing aid is rotated ninety degrees as compared with receivers 18 illustrated in the previous embodiments, so that the outer portion 119A of the acoustic chamber faces outwardly of the drawing. Chamber housing 121 for transducer 118 may be as previously described; the vent for housing 121 is on the opposite side of the drawing and hence is not shown.

In hearing aid 210 there are two sound outlet passages 122A and 122B segregated from each other by a central divider 123 in portion 12 of the hearing aid housing 11. In this instance, the solvent for ear wax is pumped into one of the two sound outlet passages 122A, 122B, flows throughout the length of that passage and into portion 119A of the acoustic chamber, where it washes off the exposed face of diaphragm 126. The solvent then flows out the other of the two sound outlet passages, flushing the ear wax and other debris with it. In this construction, one part of the sound outlet passage functions as the cleaning passage. In all other respects, operation may be as described above for the other embodiments.

I claim:

1. A cleanable electroacoustic transducer device of the kind that fits into an ear canal of a user, comprising:

a housing having a size and configuration adapted to fit into said ear canal;

a sound outlet passage extending from an inner end in an interior of the housing to an outer end that opens into the ear canal of the user;

an acoustic chamber positioned within the housing, in communication with the inner end of the sound outlet passage;

a sound generating diaphragm mounted in the acoustic chamber;

acoustic drive means, mounted in the housing, for driving the diaphragm;

actuating means, including a microphone and amplifier mounted in the housing, for actuating the acoustic drive means;

and a cleaning passage, extending into the housing and into communication with the inner end of the sound outlet passage, the two passages comprising a continuous conduit such that a solvent pumped into one end of the cleaning passage from outside the housing flows through the full length of the outlet passage to clean out accumulated cerumen without disassembly of the device.

2. A cleanable electroacoustic transducer according to claim 1 in which: an outer portion of the acoustic chamber, on one side of the diaphragm facing the sound outlet passage, connects the cleaning passage to the sound outlet passage, so that the flow of solvent cleans cerumen from the one side of the diaphragm.

3. A cleanable electroacoustic transducer according to claim 2 in which the continuous conduit through which solvent is pumped is generally linear in configuration, extending from an exterior wall of the housing into the acoustic chamber, past the diaphragm, and out through the outlet passage.

4. A cleanable electroacoustic transducer according to claim 2 in which the continuous conduit through which solvent is pumped enters the acoustic chamber in a direction approximately normal to the diaphragm and at a point in that chamber remote from the sound outlet passage.

5. A cleanable electroacoustic transducer according to claim 1 in which the cleaning passage constitutes a second sound outlet passage parallel to but isolated from the first sound outlet passage, the two passages being interconnected by the acoustic chamber.

6. A cleanable electroacoustic transducer according to claim 2 and further comprising vent means for venting the acoustic chamber to the air outside the housing, through a vent path independent of the outer portion of the acoustic chamber.

7. A cleanable electroacoustic transducer according to claim 6 and further comprising damping means, incorporated in the vent means, for modifying frequency response characteristics of the hearing aid.

8. An electroacoustic transducer for a hearing aid device that fits into an ear canal of a user, the device being of the kind that includes:

a housing having a size and configuration adapted to fit into said ear canal;

and a sound outlet passage, extending from an inner end in an interior of the housing, to an outer end that opens into the ear canal of the user;

the transducer comprising:

an acoustic chamber adapted to be positioned within the housing in communication with the inner end of the sound outlet passage;

a sound generating diaphragm mounted in the acoustic chamber;

acoustic drive means for driving the diaphragm;

and a cleaning port in the acoustic chamber adapted for connection to a cleaning passage opening into the housing, to pass a solvent pumped into the cleaning passage through the entire outlet passage to clean out accumulated cerumen without disassembly of the device.

9. An electroacoustic transducer according to claim 8 in which an outer portion of the acoustic chamber, on one side of the diaphragm facing the sound outlet passage, connects the cleaning port to the sound outlet passage so that the flow of solvent cleans cerumen from the one side of the diaphragm.

10. An electroacoustic transducer according to claim 9 in which the acoustic drive means is mounted in the acoustic chamber adjacent the other side of the diaphragm.

11. An electroacoustic transducer according to claim 8 and further comprising damping means, in a wall of the acoustic chamber, for modifying frequency response characteristics of the device.

* * * * *